US006598364B1

(12) United States Patent
Pelles

(10) Patent No.: US 6,598,364 B1
(45) Date of Patent: Jul. 29, 2003

(54) ADJUSTABLE HEIGHT CONCRETE CONTRACTION AND EXPANSION JOINTS

(75) Inventor: Gideon Pelles, Kibbutz Mahanayim (IL)

(73) Assignee: Diuk Energy, Kibbutz Mahanayim (IL)

( * ) Notice: Subject to any disclaimer, the term of this patent is extended or adjusted under 35 U.S.C. 154(b) by 0 days.

(21) Appl. No.: 09/889,288

(22) PCT Filed: Jan. 16, 2000

(86) PCT No.: PCT/IL00/00028

§ 371 (c)(1),
(2), (4) Date: Jul. 16, 2001

(87) PCT Pub. No.: WO00/42265

PCT Pub. Date: Jul. 20, 2000

(30) Foreign Application Priority Data

Jan. 17, 1999 (IL) ..... 128083

(51) Int. Cl.[7] ..... E01C 11/10

(52) U.S. Cl. ..... 52/396.02; 52/396.04; 52/396.05; 404/47; 404/48

(58) Field of Search ..... 52/396.02, 396.04, 52/396.05, 318, 126.6, 126.7; 404/47, 48, 68, 69

(56) References Cited

U.S. PATENT DOCUMENTS

| | | | | | |
|---|---|---|---|---|---|
| 1,880,725 | A | * | 10/1932 | Bleck | 404/48 |
| 2,016,858 | A | * | 10/1935 | Hall | 404/68 |
| 2,040,367 | A | * | 5/1936 | Eichelman et al. | 404/60 |
| RE20,378 | E | * | 5/1937 | Hall et al. | 404/69 |
| 2,138,817 | A | | 12/1938 | Jacobson | |
| 2,405,844 | A | * | 8/1946 | Mortenson | 404/69 |
| 2,956,653 | A | | 10/1960 | Liskey, Jr. | |
| 3,385,017 | A | * | 5/1968 | Williams | 404/68 |
| 3,387,544 | A | * | 6/1968 | MacLellan et al. | 404/40 |
| 3,677,145 | A | * | 7/1972 | Wattiez | 404/47 |
| 3,782,846 | A | * | 1/1974 | Johnson | 404/48 |
| 3,880,539 | A | | 4/1975 | Brown | |
| 4,007,994 | A | * | 2/1977 | Brown | 14/73.1 |
| 4,050,206 | A | | 9/1977 | Utsuyama | |
| 4,127,352 | A | * | 11/1978 | Peters | 404/68 |
| 4,198,176 | A | | 4/1980 | Bentz | |
| 4,346,542 | A | * | 8/1982 | Tateno | 404/48 |
| 4,388,016 | A | * | 6/1983 | Levey | 404/48 |
| 4,875,801 | A | | 10/1989 | Montrym | |
| 4,979,486 | A | | 12/1990 | Hill | |
| 5,048,249 | A | * | 9/1991 | Shreiner et al. | 404/64 |
| 5,450,699 | A | * | 9/1995 | Lee | 404/48 |

* cited by examiner

*Primary Examiner*—Korie Chan
*Assistant Examiner*—Ingrid Weinhold
(74) *Attorney, Agent, or Firm*—Edward Langer; Shiboleth, Yisraeli, Robert Zisman & Co.

(57) ABSTRACT

A concrete contraction and expansion joint with a mechanism providing adjustable height, enabling fast, efficient pouring of concrete over layout surfaces, achieving accurate thickness and desired slope of the concrete slab. In a preferred embodiment, the concrete section joint assembly (35) is pre-formed by using longitudinal sections having a channel (37) for holding elastomeric material (42), with the section supported from its underside by shaped support units, each mounted on two threaded studs (24). A specially designed nut (28) threaded on each stud (24) provides height adjustability and by rotation raises or lowers the height of support unit sides. The height adjustment, provided from above the assembly, can be performed before concrete pouring is completed and an upper edge portion of the elastomeric material or the upper edges of the channel are visible with the concrete surface, providing a reference height and slope for the concrete surface. Another embodiment provides a surface level guide for mortar or plaster work in wall finishing.

17 Claims, 16 Drawing Sheets

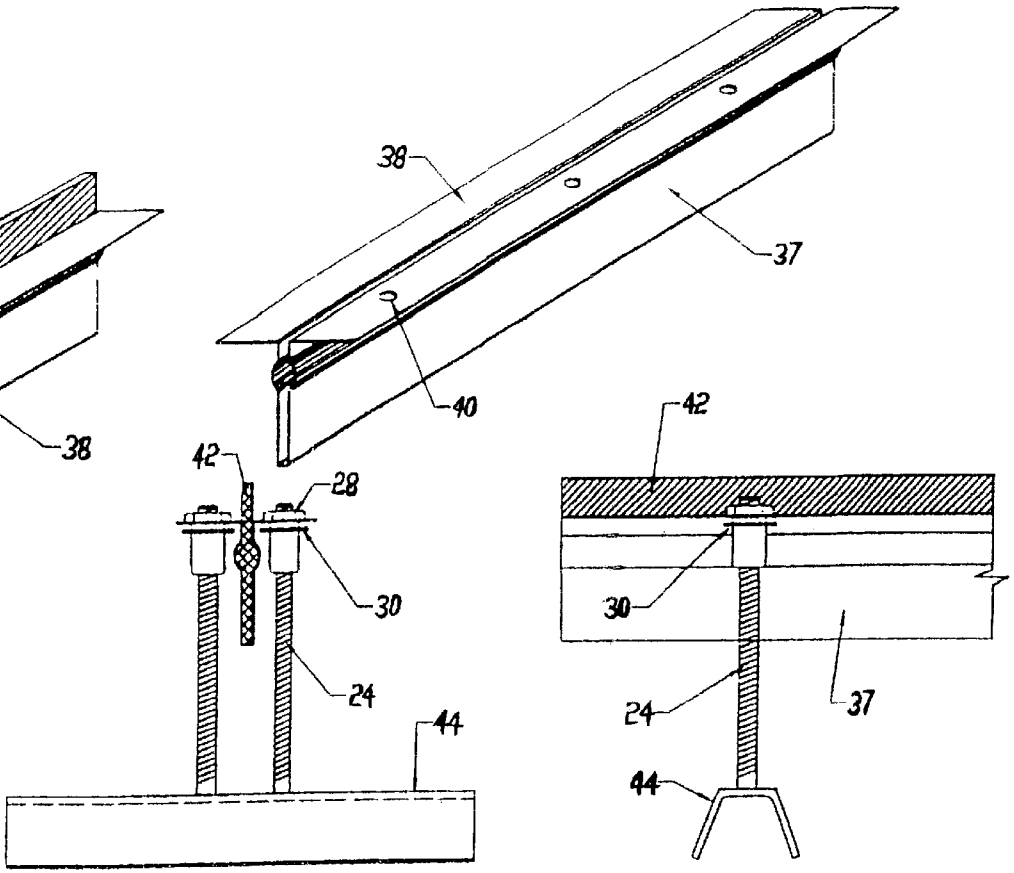
Fig.2c
Fig.2b
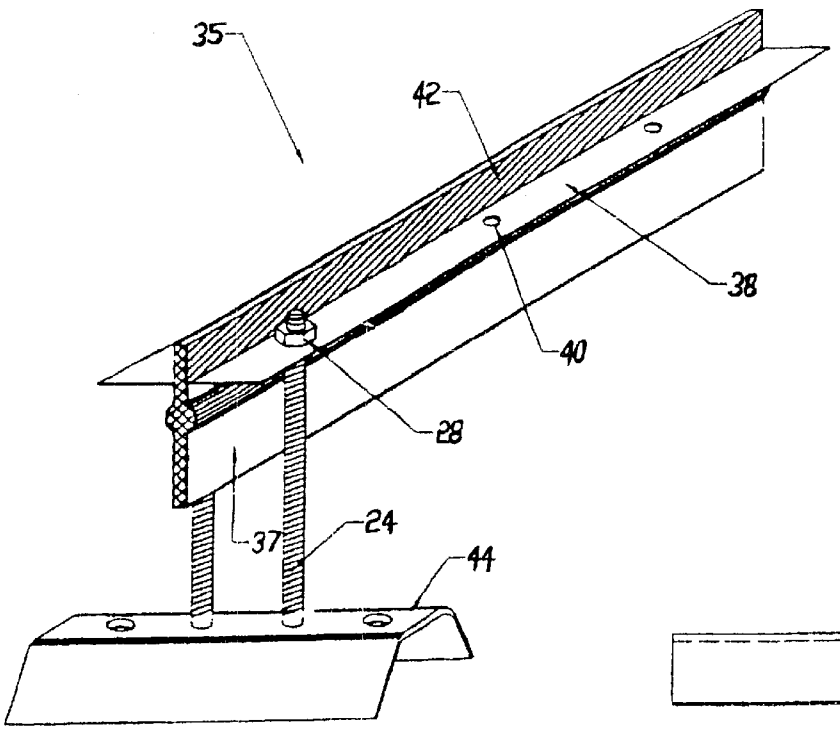
Fig.2a

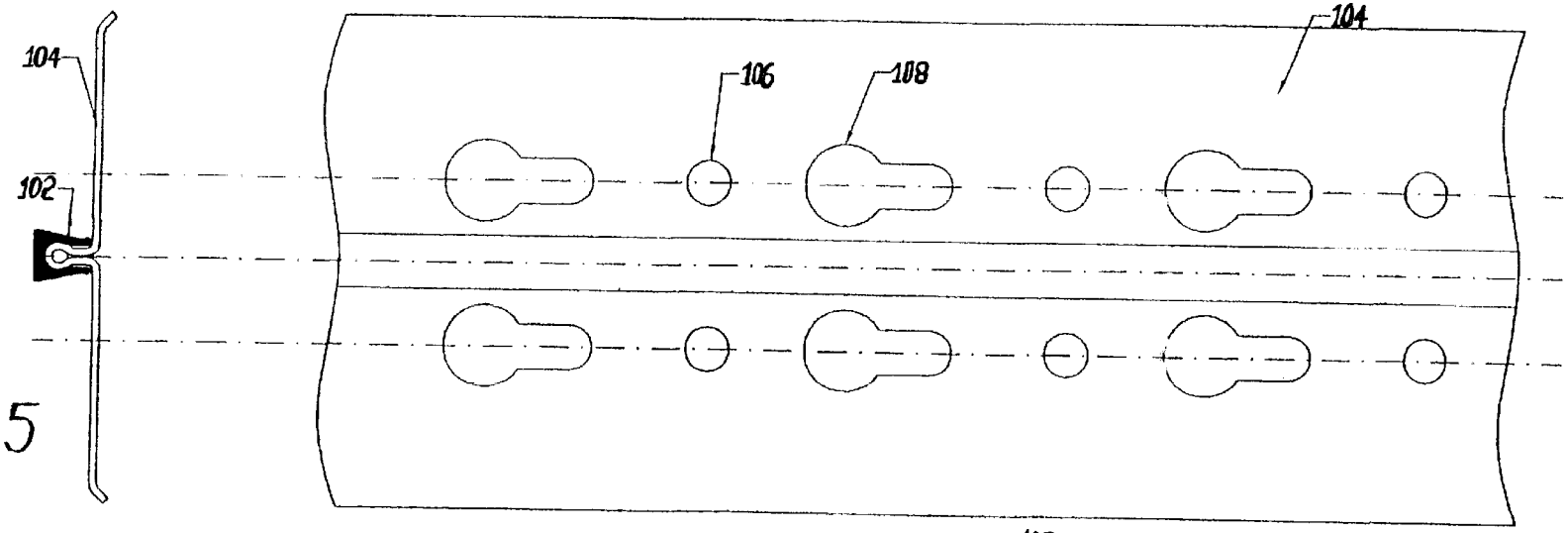
Fig.14
Fig.15
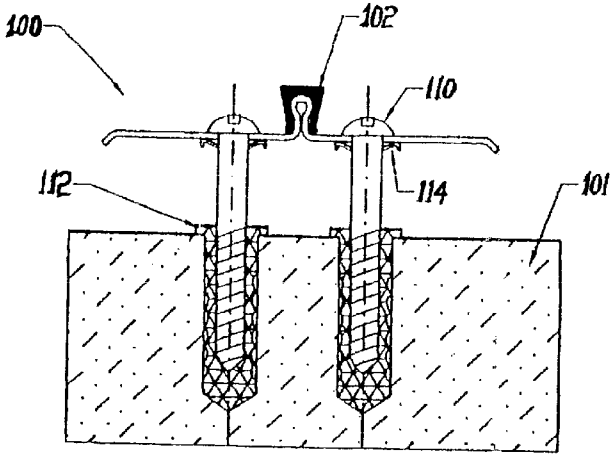
Fig.16

ADJUSTABLE HEIGHT CONCRETE CONTRACTION AND EXPANSION JOINTS

FIELD OF THE INVENTION

The present invention relates to construction and building materials and methods and more particularly, to adjustable height concrete expansion joints enabling easy height adjustment for accurate leveling of concrete surfaces, and providing pre-fabricated joints for same.

BACKGROUND OF THE INVENTION

Concrete expansion joints are an essential component in the proper construction of many large concrete surfaces, such as floors, roofs, parking lots, roads, airport runways and the like. These joints enable expansion and contraction of the concrete or mortar surfaces based on surrounding temperatures, which reach hot and cold extremes, respectively, in summer and winter periods, and other factors including shifting of soil underneath the slabs. These joints are meant to eliminate the deterioration of the slab due to random cracks which otherwise form in the concrete.

As used herein the term "joints" applies equally to expansion and contraction joints.

In pouring concrete over a large surface and insuring that it spreads evenly, reference marks are needed to indicate the height of the concrete slab. In many cases where forms are used to define areas into which concrete is poured, flexible joint materials are placed into the grooves resulting when the forms are removed. A leveling string is stretched from a stud at the corners of the forms, and the stud is vertically adjustable by use of a nut, to provide the reference for pouring the concrete. This task requires much time and effort and still leaves irregularities in the concrete surface.

Existing methods of providing joints in concrete slabs include the method of saw cutting a groove for the joint in the solid concrete, and this requires specially designed diamond saw cutting blades, which have a very short useful life and are very expensive. In addition, there is a limiting time factor, since the sawcut must be performed within a short period after pouring the concrete.

In U.S. Pat. No. 4,050,206 to Utsuyama, an improved jointing material is disclosed for placement on a support assembly having an adjustable height to provide a reference surface. The support assembly comprises leg assemblies which are adjusted to the desired reference surface height, by bending the legs toward and away from each other. This adjustment is neither consistent nor convenient for all of the support assemblies.

A product commercially available from Thorbjorn Lund Sweden, known as Combiform, discloses a method of supporting a screed rail with a ground plate having adjustment screws to adjust the rail height. The adjusting screws are supported by a ground plate placed under the rail, so that these screws are at a low level, and once concrete is poured over these, no further adjustment is possible. This limits flexibility in construction.

U.S. Pat. No. 4,198,176 to Bentz discloses a concrete expansion joint forming structure in which a U-shaped metallic sheet holder supports an expansion joint. The holder is supported on a pair of chisel-shaped pegs driven into the ground before pouring concrete around the area to set the expansion joints. No height adjustment is described for the pegs once they are set.

U.S. Pat. No. 4,875,801 to Montrym discloses an expansion joint brace with ground pegs for setting the brace before pouring concrete. As before, no height adjustment is described for the pegs once they are set.

In U.S. Pat. No. 4,979,846 to Hill et al., there is disclosed a contraction joint for concrete linings in which a triangular-shaped section is placed with its apex protruding over a reference surface of concrete, but without a height adjustment.

Therefore, it would be desirable to provide a concrete joint which is also capable of height adjustment to establish a desired reference surface height for pouring concrete.

The reference surface height (thickness) problem also applies to the construction of walls, when it is necessary to straighten the wall surface or slope when applying mortar or during plastering, to achieve a thin layer, usually less than 2–3 cm, with a high degree of precision.

Therefore, it would also be desirable to provide a surface level guide for mortar or plaster work in wall finishing.

SUMMARY OF THE INVENTION

Accordingly, it is a principal object of the present invention to overcome the disadvantages of prior art concrete expansion joints and provide a concrete expansion joint with a simple mechanism providing adjustable height, enabling faster, more efficient pouring of concrete over large layout surfaces, to achieve accurate thickness and desired slope of the concrete slab.

It is another object of the invention to provide a surface level guide for mortar or plaster work in wall finishing.

In accordance with a preferred embodiment of the present invention, there is provided an adjustable height concrete section joint assembly for placement prior to pouring a concrete slab surface, comprising:

section means extending longitudinally and being shaped for holding a flexible material; and means for supporting said section means at an adjustable height, said height adjustment being provided before completion of pouring of concrete, such that an upper edge portion of said section means is visible at the concrete slab surface, providing it with a desired reference height and slope.

In a preferred embodiment, the concrete section joint assembly is pre-formed by use of longitudinal sections having a channel formed therein for holding elastomeric material, with the section supported from its underside by shaped support units. Each support unit is supported on a pair of threaded studs, by a specially designed nut threaded on each stud, so as to be adjustable in height. The nut has formed therein a groove into which an omega-shaped retaining spring can be inserted, to support each side of the unit. Rotation of the nut raises or lowers the height of each support unit side.

The height adjustment is provided from above the assembly and can be performed before completion of pouring the concrete, such that an upper edge portion of the elastomeric material or the upper edges of the channel are visible even with the concrete surface, providing a desired reference height and slope for the concrete surface.

This embodiment using elastomeric material provides a joint meant to eliminate the random cracks which form in the concrete.

In an alternative embodiment, the section is replaced by a rail means that extends longitudinally and is formed with a protruding inverted U-shaped middle rib with a flexible rib covering the inverted U-shaped middle rib. The rail means is supported from its underside on a pair of threaded studs, by the specially designed nut threaded on each stud, so as to be adjustable in height.

The rail means is intended to form weakness lines which guide the cracks which form in the concrete, and to provide a very accurate reference level for leveling the concrete slab surface during pouring.

The present invention is designed to allow access to the specially designed nut from above the support assembly, to allow the height and slope adjustment to be performed before and during the pouring of concrete, thus allowing greater freedom in achieving the correct adjustment, while saving set-up costs.

The inventive technique eliminates the need to saw the joint in the concrete, as with prior art methods, since the joint is ready before the concrete is poured.

In yet another alternative embodiment, the concrete expansion joint assembly section is formed from a protruding rib-like structure whose two sides are slightly open on its underside, and provided with horizontal wings extending from both sides and integral to them, the whole forming an inverted, longitudinal T-shaped profile. The assembly section is supported from its underside by a flat support unit, a suitable number of such units being appropriately spaced along the axis of the joint assembly section. The support unit is provided with pre-cut foldable tabs which, when folded over the horizontal wing surfaces of the assembly section, secure the support unit to the section. Each support unit is itself supported on a pair of threaded studs integrally formed with a raised base structure. The studs are provided with a specially-designed nut threaded on each stud, so as to be adjustable in height. The nut has formed therein a groove into which an omega-shaped retaining spring can be inserted, to support each side of the support unit. Rotation of the nut raises or lowers the height of each support unit side for leveling and aligning the joint section. As in the previously-described embodiment, the height adjustment is provided from above the assembly section and can be performed before completion of pouring the concrete, such that an upper edge portion of the section is visible even with the concrete surface to be poured, providing a desired reference height and slope for the finished concrete surface.

In another alternative embodiment, the invention provides a surface level guide for mortar or plaster work in wall finishing, comprising a rail having a protruding inverted U-shaped middle rib integrally formed with horizontal flanges, which are formed with a plurality of spaced apart mounting holes, designed to allow permanent or removable mounting of the rail.

Other features and advantages of the invention will become apparent from the following drawings and description.

BRIEF DESCRIPTION OF THE DRAWINGS

For a better understanding of the present invention with regard to the embodiments thereof, reference is made to the accompanying drawings, in which like numerals designate corresponding elements or sections throughout, and in which:

FIGS. 2*a–c*; 3*a–c*; 4*a–c*; and 5*a–c* each illustrate perspective, front and side views of various alternative embodiments of a novel concrete contraction joint, each featuring a different form and assembly.

FIGS. 14–16 show, respectively, top, side and elevation views of an alternative embodiment used as a surface level guide.

DETAILED DESCRIPTION OF THE PREFERRED EMBODIMENTS

Figure 1A:
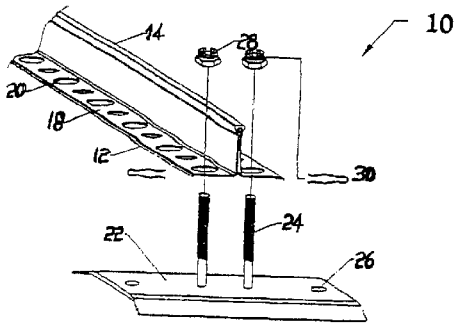
FIGS. 1*a–d* illustrate, respectively, perspective and side views of a preferred embodiment of an adjustable height concrete section joint constructed and operated in accordance with the principles of the present invention.

Referring now to FIGS. 1*a–d*, there are illustrated, respectively, perspective and front views of an adjustable height concrete section joint assembly 10 constructed and operated in accordance with the principles of the present invention. Assembly 10 comprises a rail 12 having a protruding inverted U-shaped middle rib 14 and side walls 16 integrally formed with horizontal flanges 18, which are formed with a plurality of spaced apart mounting holes 20. A base 22 is formed integrally with a pair of threaded mounting studs 24 extending perpendicular thereto, and base 22 is formed with anchoring holes 26.

In accordance with the principles of the present invention, joint assembly 10 is provided with a specially-designed threaded nut 28 which is formed with a groove, into which an omega-shaped retaining spring 30 can be inserted. Spring 30 serves to hold the rail 12 at the vertical height on stud 24 to which threaded nut 28 is adjusted. The simple adjustment is performed from above joint assembly 10.

Figure 1B:
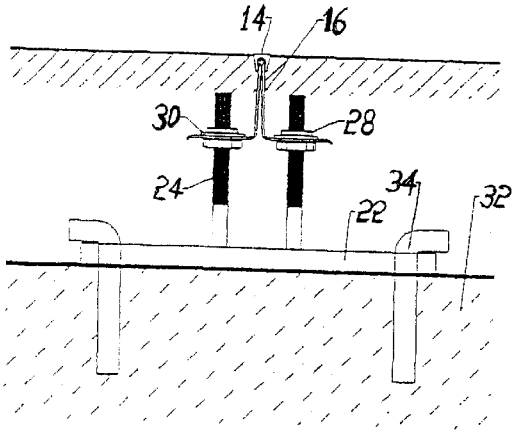
Figure 1C:
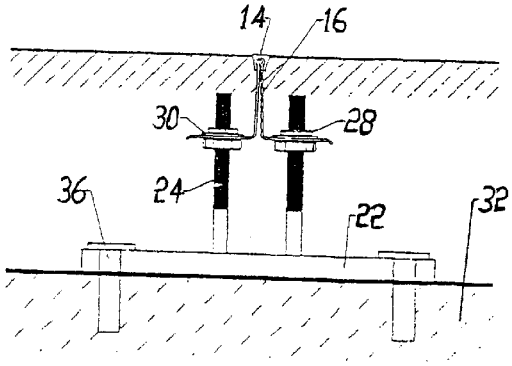

As shown in FIG. 1*b*, base 22 is seated on a platform 32 and securely attached thereto by a pair of pins 34 which are driven into platform 32. Before concrete is poured over platform 32, the height of rail 12 can be adjusted, as shown in FIG. 1*c*, so that rib covering 14 is at the desired height for the concrete surface FIG. 1*c* shows an alternate mounting arrangement for base 22 on platform 32, by use of molly-type anchors and bolts 36.

Figure 1D:
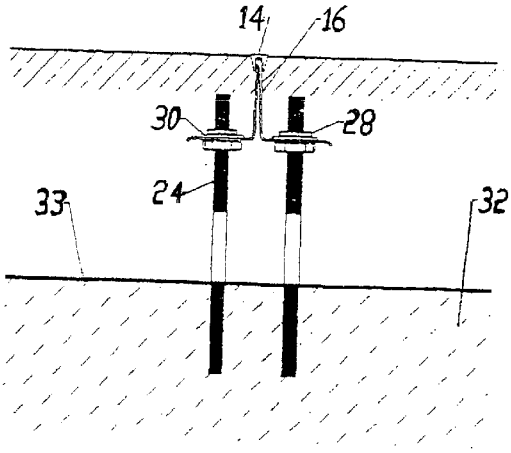

In FIG. 1*d*, platform 32 is shown as a pre-cast concrete base, and the concrete section joint assembly 10 is shown after the concrete has been poured over platform 32, in a procedure known as topping its surface 33. The support assembly comprises two mounting studs only, with their lower portion covered with shrink wrap plastic which serves to stabilize the studs in the pre-cast concrete. When topping concrete is poured over the entire assembly 10, rib covering 14 is visible flush with the topping layer.

In FIGS. 2*a–c*, there are shown perspective, front and side views of an alternative embodiment of the inventive concrete expansion joint assembly 35, in which U-shaped rail 12 is replaced by a longitudinal section formed with a channel 37 and flanges 38 which have mounting holes 40 formed therein. An elastomeric material 42 constitutes the expansion joint itself, which is seated in channel 37. As with joint assembly 10, the alternative joint assembly 35 is provided with specially-designed threaded nut 28 into which spring 30 is inserted to hold the channel 37 at the vertical height to which threaded nut 28 is adjusted on studs 24, which are supported by a raised base 44.

Before concrete is poured over base 44, the height of channel 37 can be adjusted to fix the top edge of material 42 at the desired height for the concrete surface. This adjustment provides a reference level for use in pouring concrete.

Figure 3C:
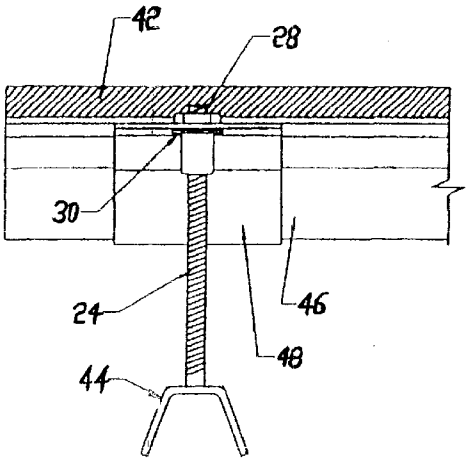
Figure 3B:
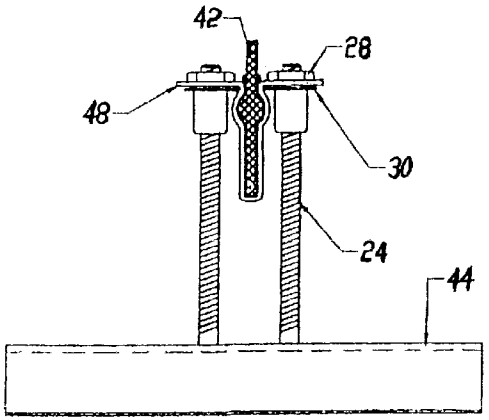
Figure 3A:
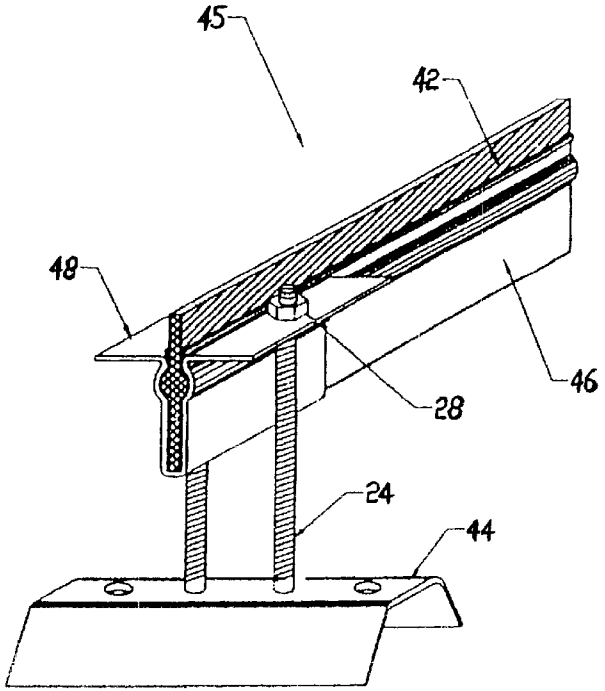

In FIGS. 3*a–c*, there are shown perspective, front and side views of another alternative embodiment of the inventive concrete expansion joint assembly 45, in which longitudinal channel 37 is replaced by a channel 46 for holding elastomeric material 42. In this example, the height dimension of elastomeric material 42 is greater than shown in FIGS. 2*a–c*, such that the expansion joint extends to a greater depth. Channel 46 is supported by a flanged support bracket 48 having a narrow width. A plurality of spaced apart brackets 48 are placed along the expansion joint overall length. Again, the alternative joint assembly 45 is provided with specially-designed threaded nuts 28, which allow vertical height adjustment on threaded studs 26.

Figure 4A:
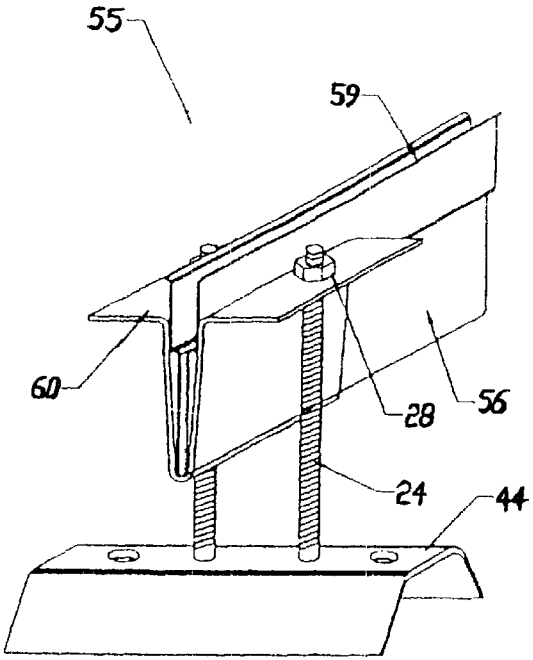
Figure 4B:
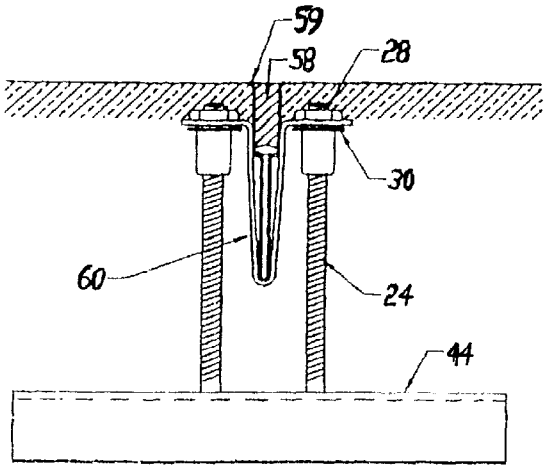
Figure 4C:
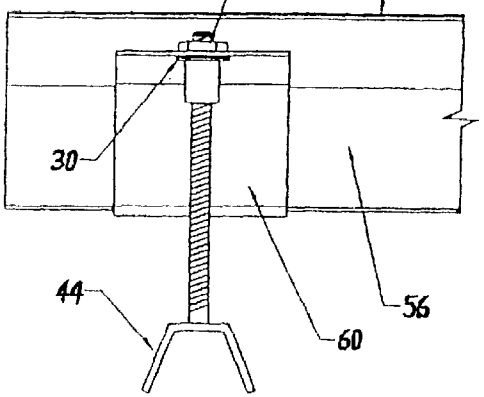

In FIGS. 4*a–c*, there are shown perspective, front and side views of yet a further alternative embodiment of the inventive concrete expansion joint assembly 55. In this embodiment, longitudinal channel 46 is replaced by a shaped channel 56 for holding elastomeric materials 58. The shape of channel 56 is similar to that of a dual thickness saw cut.

Channel 56 has slanted top edges 59 which are bent to shape the edges of the concrete slab poured over the assembly, so that the concrete under these edges hardens in the shape of a beveled edge. The channel 56 is supported by a flanged support bracket 60, which is also shaped like channel 56, and has a narrow width. A plurality of spaced apart brackets 60 are placed along the expansion joint overall length. As before, specially-designed threaded nuts 28 enable height adjustment on threaded studs 24.

The beveled edge shape of the concrete slab can also be obtained by providing the elastomeric material with an upper edge shaped with slanted edges (FIG. 7), like the shape of channel 56.

Figure 5C:
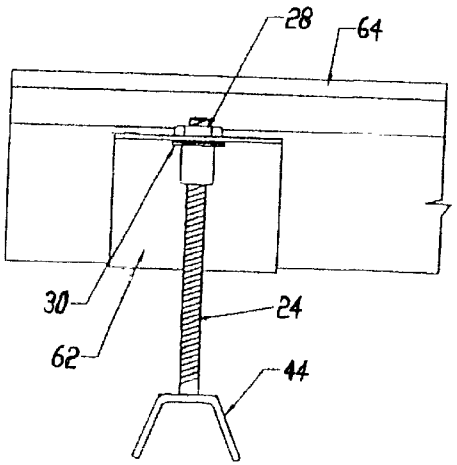
Figure 5B:
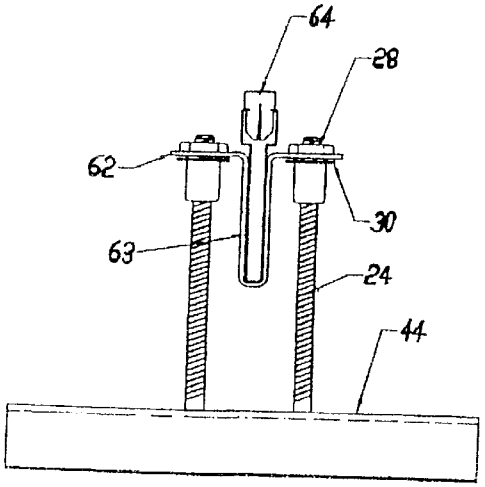
Figure 5A:
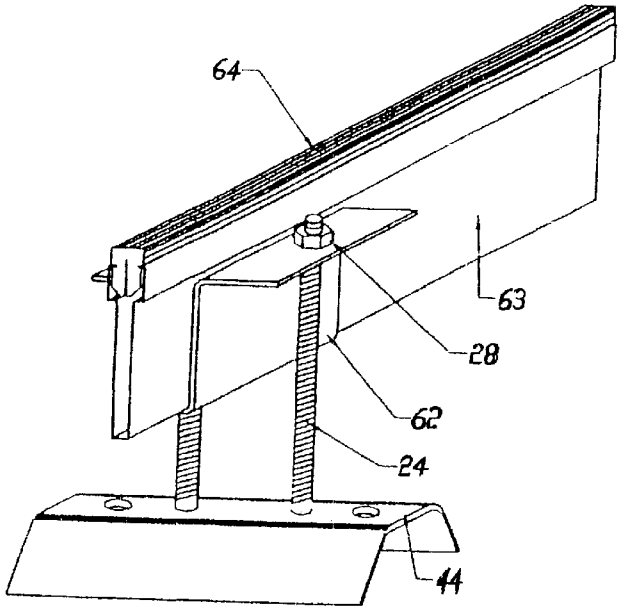

FIGS. 5*a–c* illustrate another variation of the concrete expansion joint assembly, using adjustable height support brackets 62 to support a shaped holder 63 with a different cross-section, in which thick elastomeric material 64 is seated.

Figure 6:
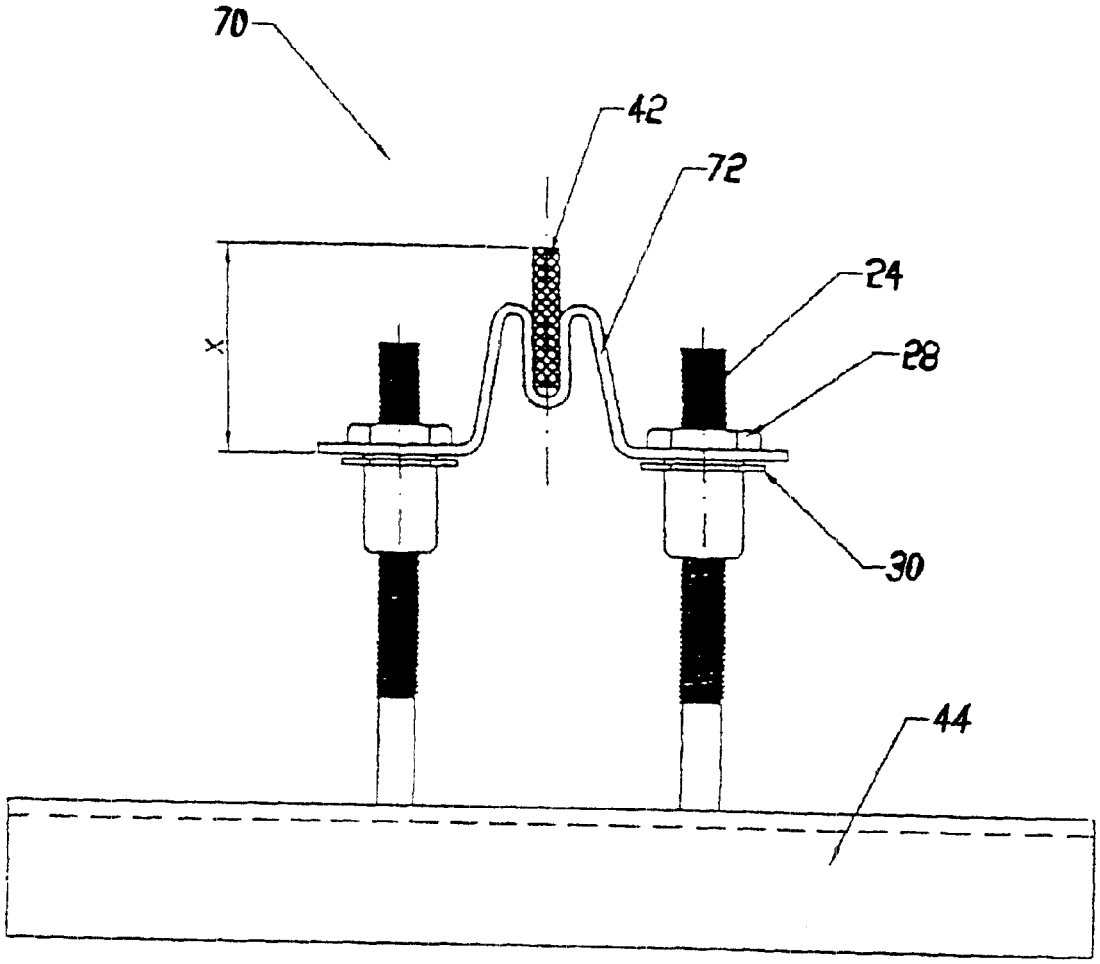
FIG. 6 is a front view of another alternative embodiment of the inventive expansion joint, featuring an inverted bracket.

FIG. 6 is a front view of another alternative embodiment of the inventive expansion joint assembly 70, featuring an inverted holder 72 for holding the elastomeric material 42. The holder 72 is shaped so as to support the elastomeric material above the top of studs 24. The resulting dimension X between the top edge of elastomeric material 42 and the horizontal edge of holder 72 provides a greater distance between the top of the concrete surface and the top of studs 24. This is important in certain applications, for greater strength.

Figures 7A, 7B, 7C, 7D:
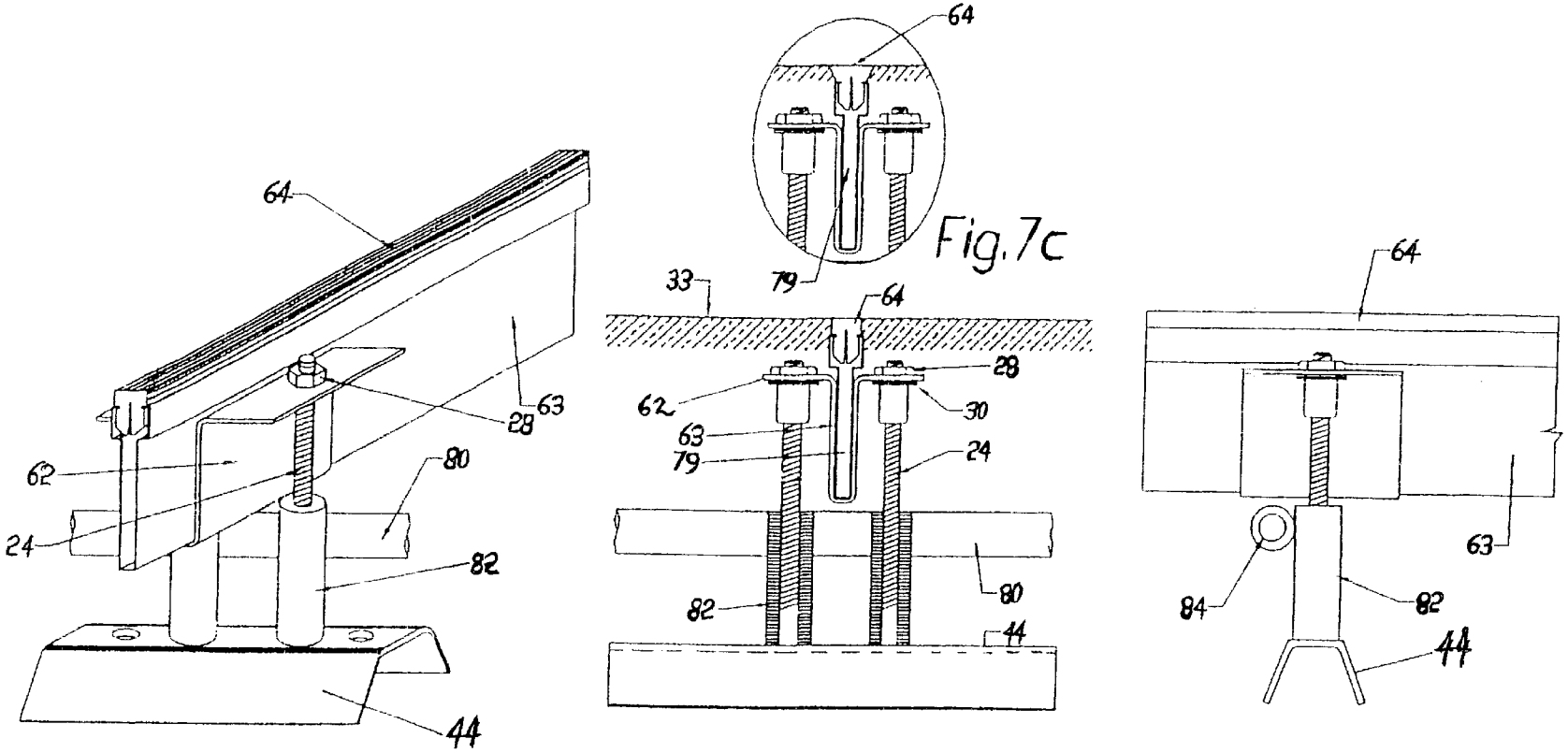
FIGS. 7*a–d* each illustrate perspective, front and side views of an alternative embodiment of a novel concrete expansion joint, featuring a dowel bar reinforcing arrangement.

FIGS. 7*a–d* each illustrate perspective, front and side views of the FIG. 5*a* embodiment of the novel concrete expansion joint, featuring a dowel bar reinforcing arrangement. The elastomeric material 64 is seated in holder 63, covering polyethylene foam material 79 placed within holder 63. In FIG. 7*b*, the front view shows a dowel bar 80 supported by a pair of hollow cylinders 82 each of which is slid over a threaded stud 24, with a hollow ring 84 (FIG. 7*d*) welded onto each cylinder 82, through which the dowel bar passes. The dowel bar arrangement is useful where the design of the concrete provided requires it. Any suitable arrangement may be used to fix the dowel bar position using the mounting studs 24.

FIGS. 7*b–c* show the elastomeric material 64 with either a straight top edge (FIG. 7*b*) or a slanted edge (FIG. 7*c*), with the concrete slab edges being formed with the appropriate shape.

Figure 8:
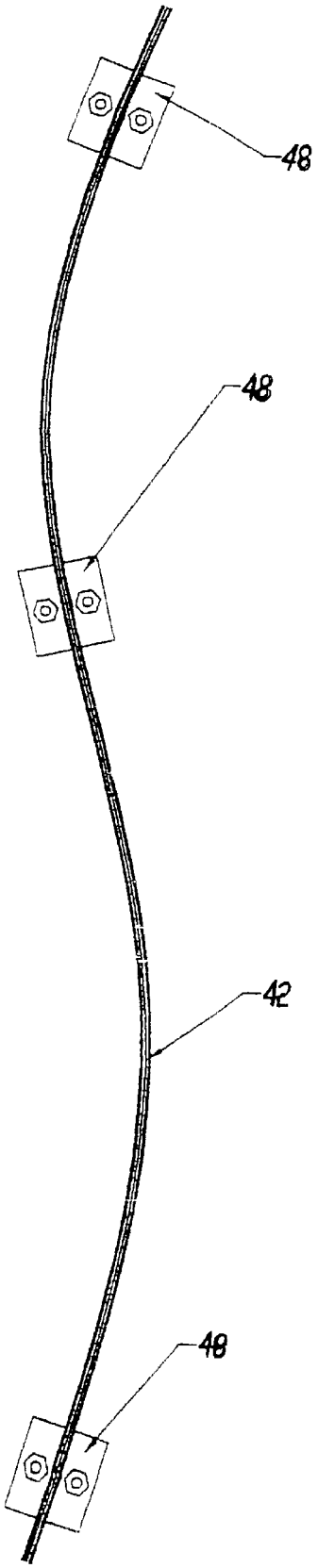
FIG. 8 is a top view of a curved expansion joint layout constructed using the inventive expansion joint assembly.

FIG. 8 is a top view of a curved expansion joint layout constructed with elastomeric material 42 using the inventive expansion joint assembly, with individual support brackets 48 placed at spaced apart locations and oriented according to the desired layout.

Figure 9:
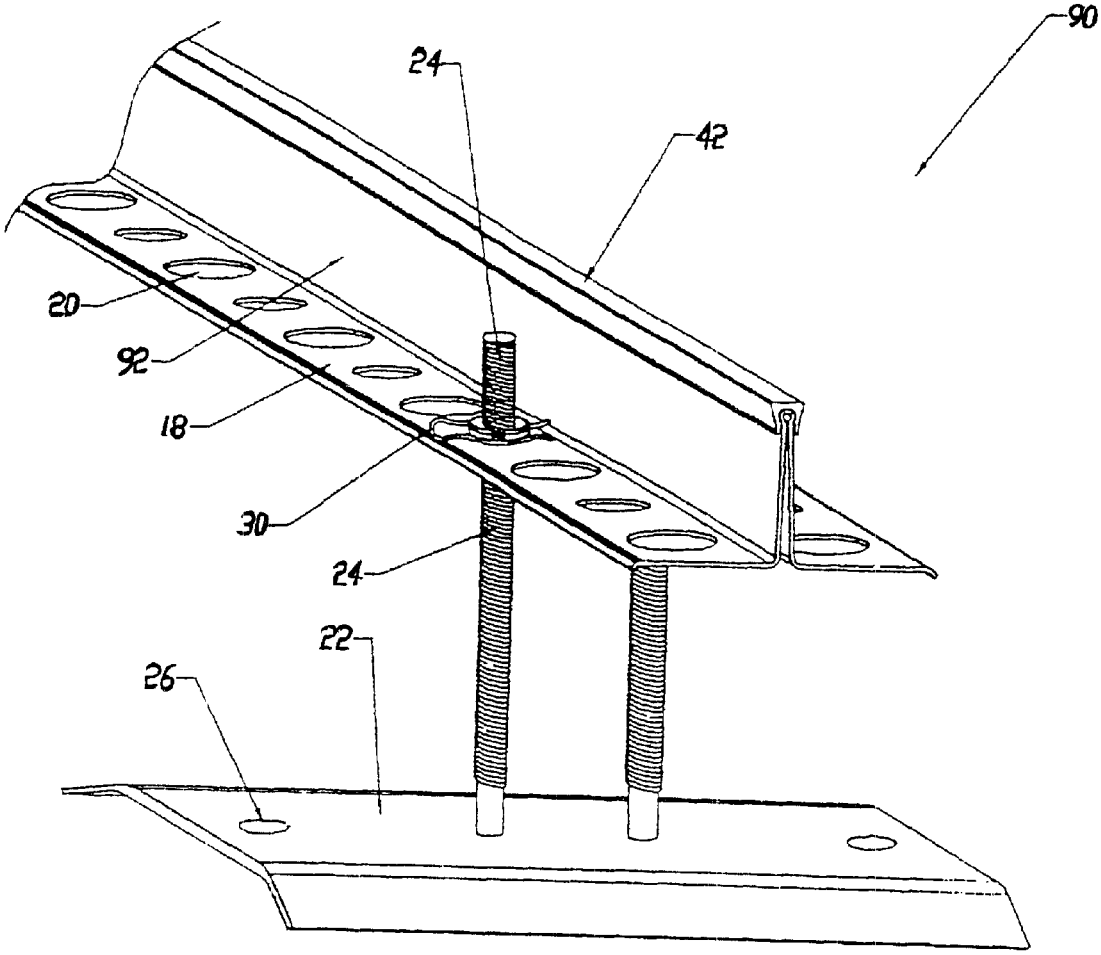
FIGS. 9–10 are respectively, perspective and front views of another alternative embodiment of the novel expansion joint.
Figure 10:
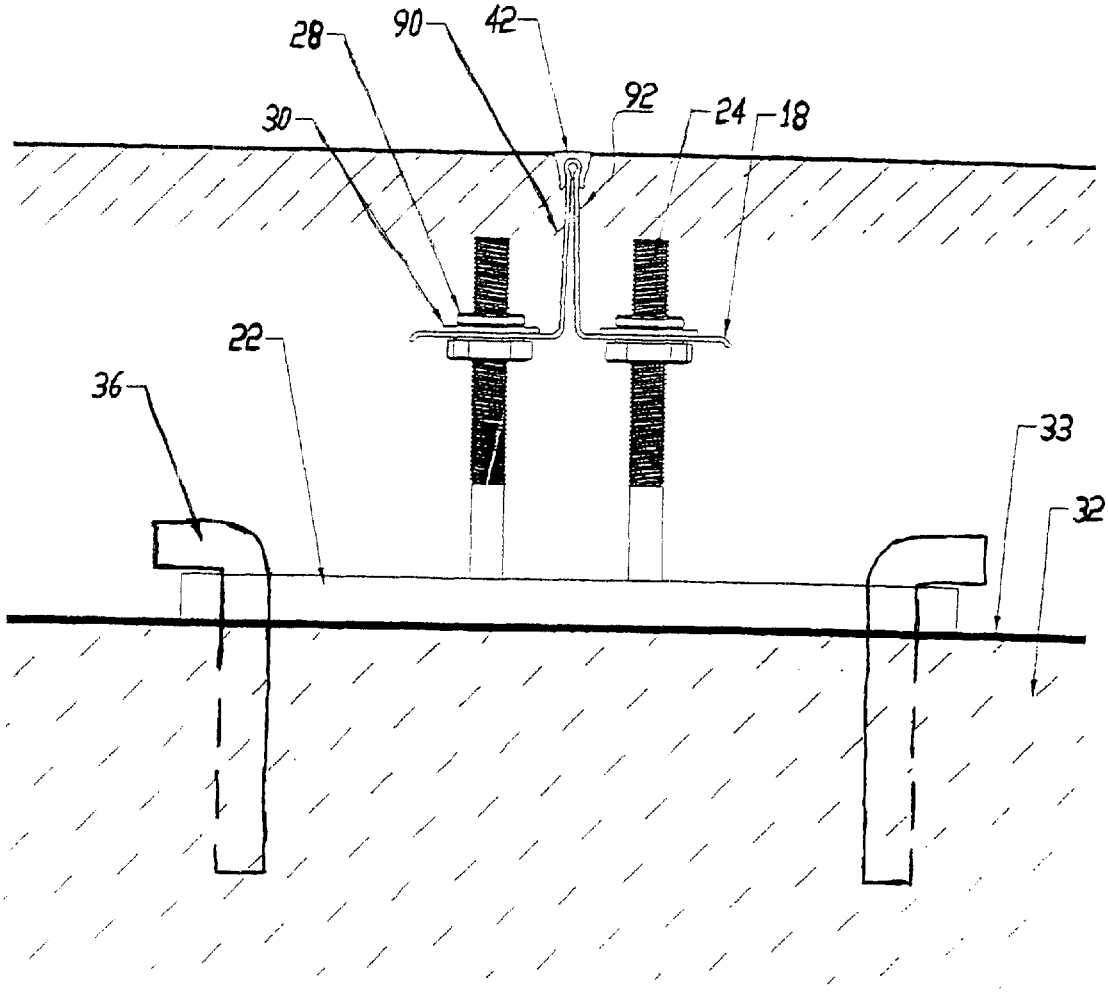

FIGS. 9–10 show respectively, perspective and front views of an alternative embodiment of the expansion joint, featuring an inverted T-shaped profile 90. Elastomeric material 42 is seated on top of profile 90 which has its side walls 92 substantially closed one against the other, in a 0–20 degree range. This profile forms a deep expansion joint, from 15 to 80 mm. The height adjustment system is as described per FIG. 1.

Figure 11:
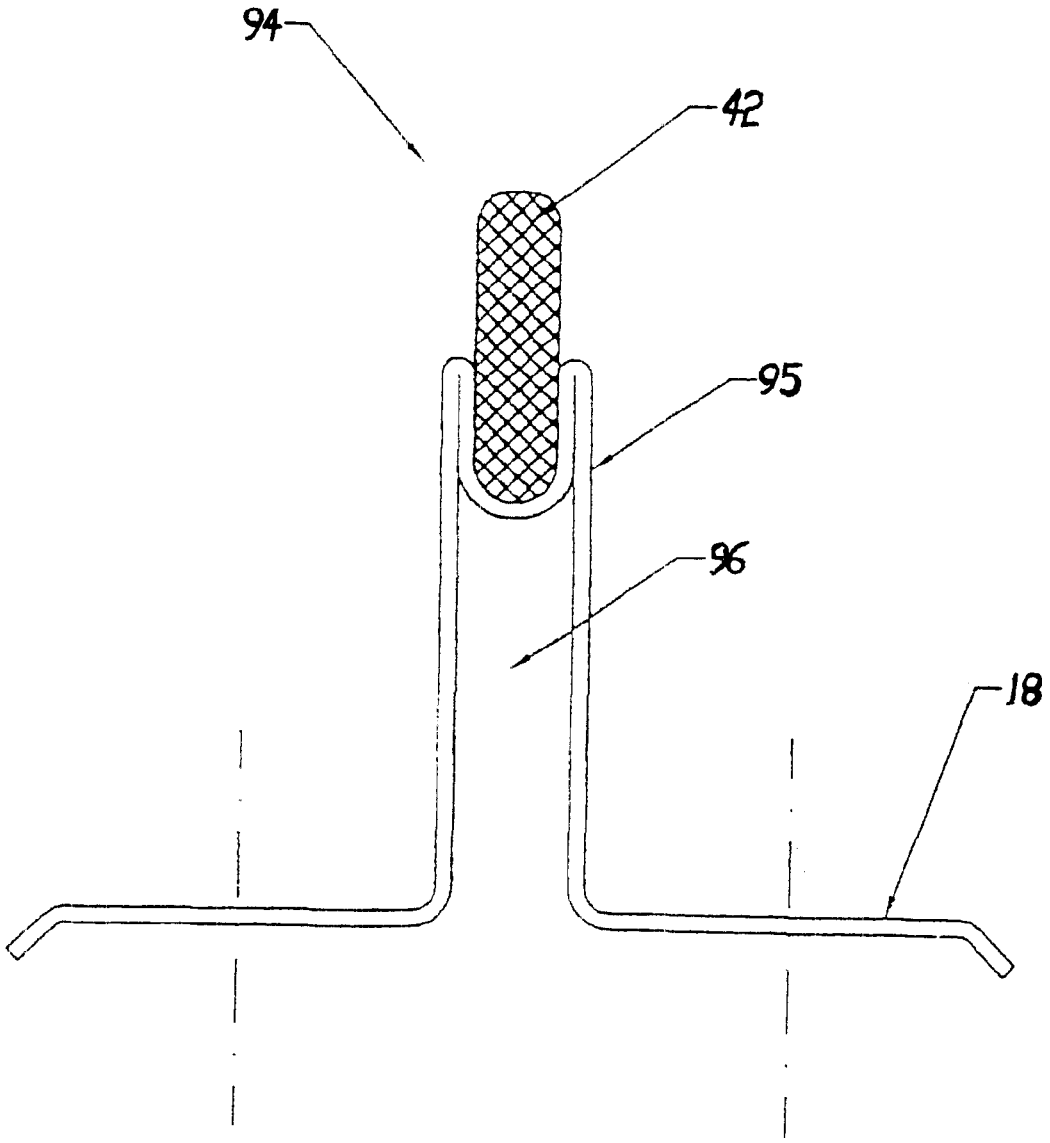
FIG. 11 is a front view of another alternative embodiment of the expansion joint, featuring an inverted holder having substantially parallel vertical sides.

In FIG. 11, there is shown a front view of another alternative embodiment of the expansion/contraction joint, in which elastomeric joint material 42 is held in place in an inverted holder 94 having substantially parallel vertical side walls 95 integrally formed with horizontal flanges 18. This part of holder 94 has no holes formed in side walls 95, thus trapping air in the space 96 between walls 95 and preventing the entry of concrete therein. The trapped air provides side pressure flexibility, so as to develop a line of weakness. The contraction of the concrete causes cracking to occur only underneath this line, and by allowing for "squeezing", the joint allows the concrete slab to expand.

Figure 13:
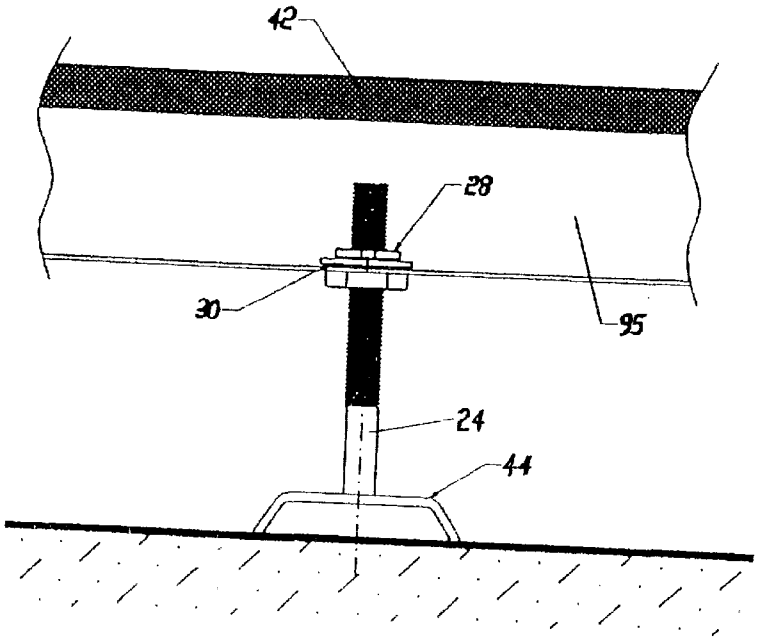
FIGS. 12–13 show front and side views of the alternative embodiment of FIG. 11 in a mounting arrangement.
Figure 12:
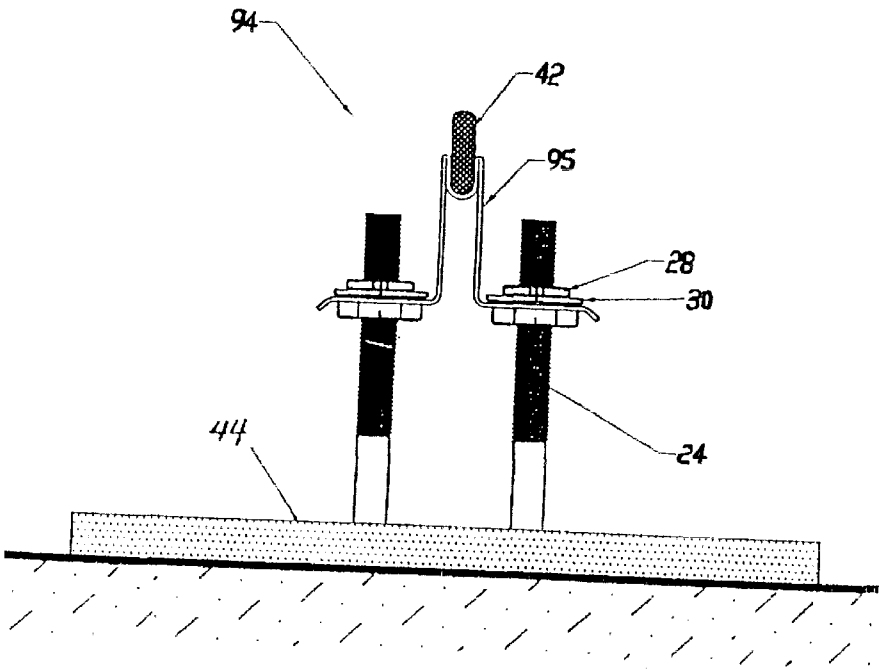

FIGS. 12–13 show front and side views of the alternative embodiment of FIG. 11 in a mounting arrangement similar to that of FIG. 10, on raised platform 44.

Referring now to FIGS. 14–16, there are shown, respectively, top, side and elevation views of an alternative embodiment used as a surface level guide 100 for mortar or plaster work in wall finishing. Guide 100 is provided as an inverted U-shaped rib 102 having integrally formed flanges 104 which are formed with a plurality of holes 106, and a plurality of keyhole-shaped holes 108, in a spaced apart pattern.

The surface level guide 100 is installed on a wall 101 which is to receive an internal or external layer of plaster, by mounting the rib 102 with its flanges 104 on screws 110. The spaced apart intervals of guide 100 are defined by the working space needed to smooth the plaster using a screed, or by the wall construction plan which defines the separate sections of the wall.

The spacing between the rib 102 and the wall, or its height above the floor, is adjustable by use of screws 110 which are threaded into wall anchors 112, mounted on the wall, or used as floor anchors. Under the head of each of the screws 110 is a one-way retaining ring 114, similar in function to the omega-shaped retaining spring 30 which is shown in previous illustrations, designed to hold the flanges 104 fixed in position on screws 110.

The mounting of horizontal flanges 104 on screws 110 can be permanent or removable. If permanent, screws 110 are placed through small holes 106, and rings 114 used to retain the flanges 104 in position. If removable, each screw 110 has a ring 114 locked in advance under its head, and flanges 104 are placed over screw 110 using the larger portion of keyhole 108, and pushed to lock it in position under the narrow keyhole 108 portion.

Once the plaster has already been smoothed over the wall surface and allowed to partially dry, the guide 100 can be removed from the wall. This is achieved by sliding it towards the larger keyhole 108 portion, and lifting it off the wall. The remaining empty groove can be filled in with fresh plaster.

Figure 17A:
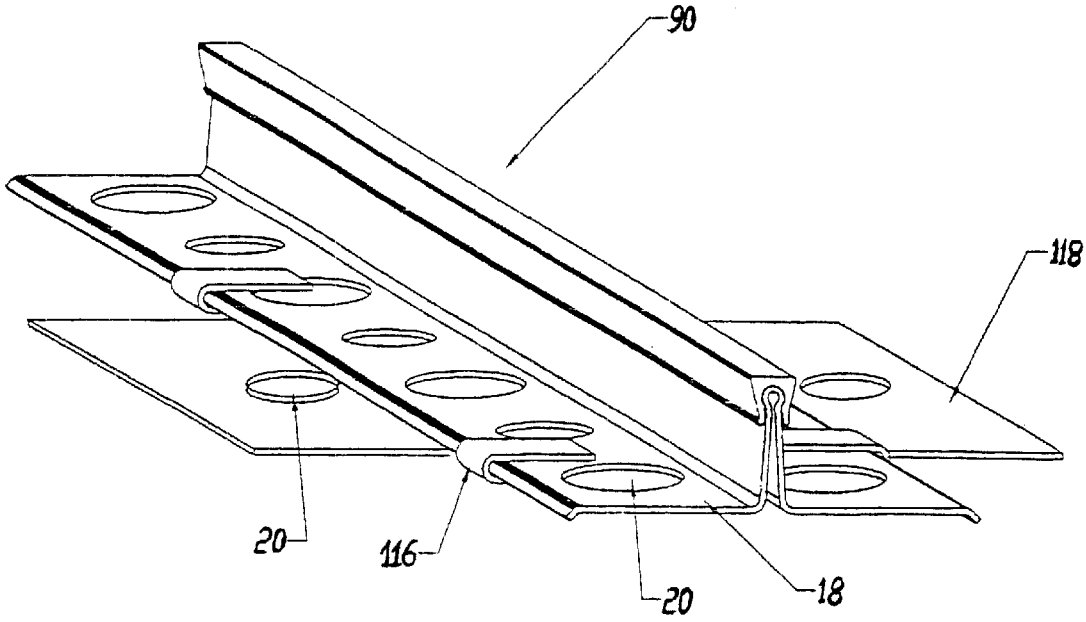
FIGS. 17*a–c* show a perspective, top and side view, respectively, of an alternative embodiment featuring a joint assembly section secured to a flat support unit by pre-cut foldable tabs integrally-formed from the support unit.

Referring now to FIGS. 17*a, b*, and *c*, there are shown respectively, perspective, top, and side views of an alternative embodiment of the concrete expansion joint assembly section comprised of an adjustable flat support unit 118 secured, by pre-cut foldable tabs 116, to an inverted T-shaped section 90. As can be seen from FIG. 17*a*, the section may be provided with a plurality of spaced-apart holes 20 which are generally used for mounting, but in this embodiment merely allow for additional channels for the poured concrete to flow freely around section 90 since in this embodiment, support unit 118 is used for the actual adjustable mounting system. Alternatively, as shown in FIG. 17*d*, section 90 may be provided without mounting holes as these are not essential to this embodiment.

Figure 17D:
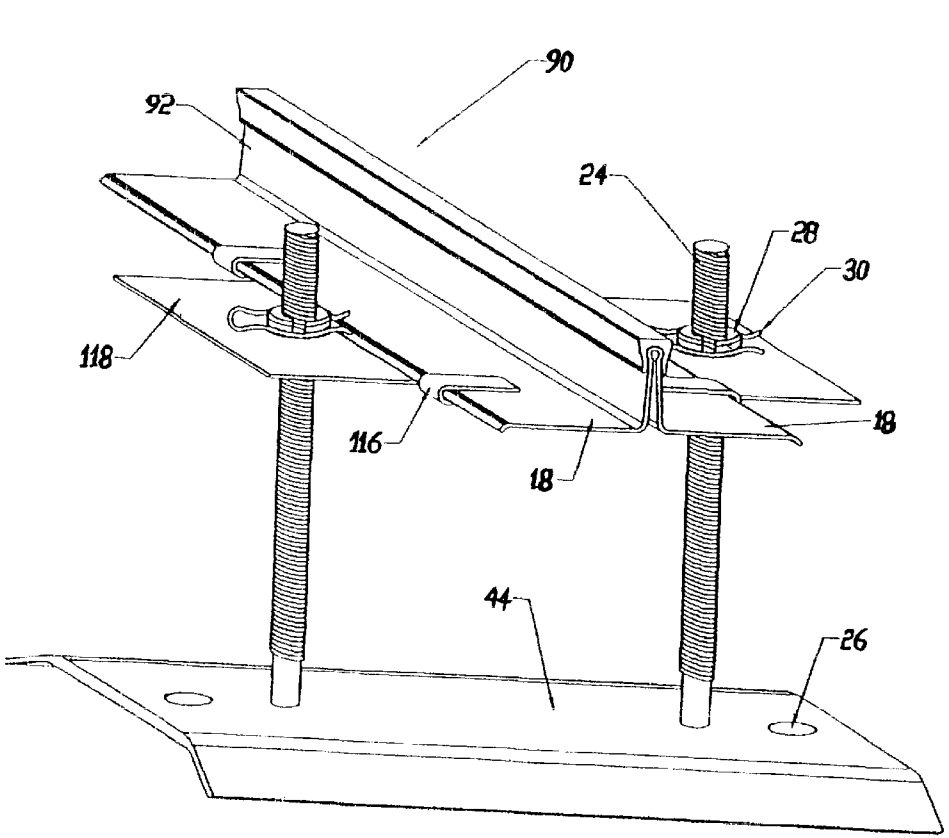
FIG. 17*d* shows the adjustable mounting assembly for the flat support unit with the tabs folded securely over the wings of the assembly section and the support unit firmly anchored by threaded mounting studs integral to a raised base, and held in place by nuts and retaining springs of the type described for prior embodiments.
Figure 17B:
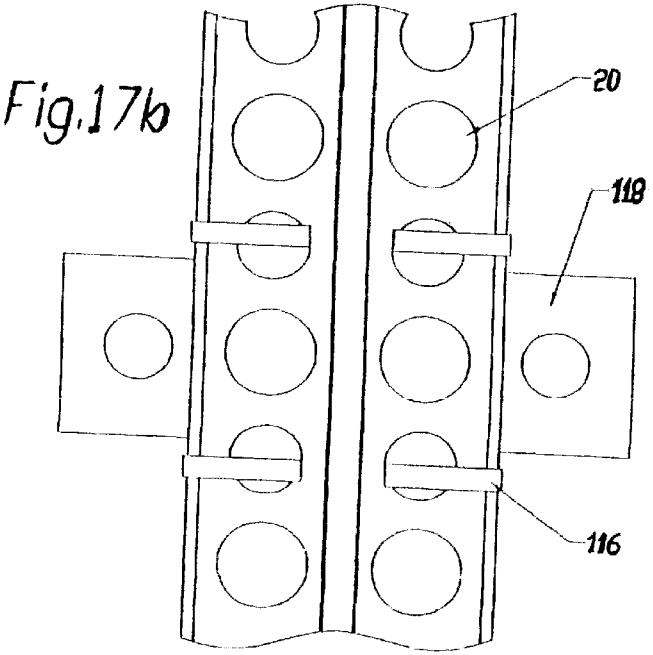
Figure 17C:
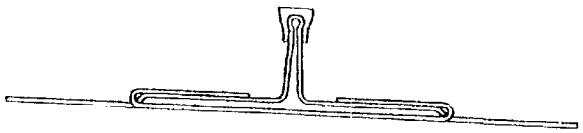

In FIG. 17*d*, the inverted T-shaped section 90 is shown secured to support unit 118 by the tabs 116 which are folded over the horizontal wings 18 of section 90. Support unit 118 is anchored to a raised base 22 formed integrally with a pair of threaded mounting studs 24 extending perpendicular thereto, and base 22 is formed with anchoring holes 26 to secure it to the bed where the concrete is to be poured, using any method known to the art.

In accordance with the principles of the present invention, the threaded mounting studs 24 are provided with specially-designed threaded nut 28 into which an omega-shaped retaining spring 30 can be inserted. Spring 30 serves to hold support unit 118 at the vertical height on stud 24 to which threaded nut 28 is adjusted. The adjustment can be done in a simple manner from above the concrete joint assembly section 90.

Figure 18:
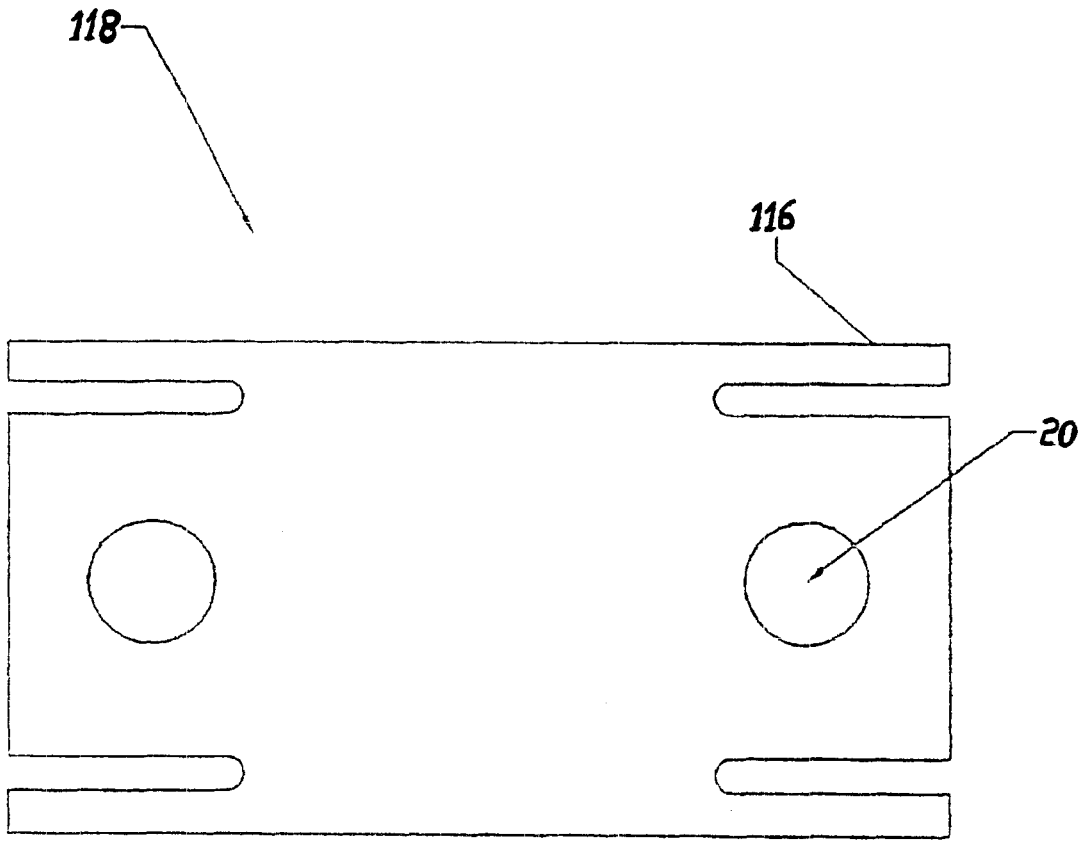
FIG. 18 shows a top view of the template used to form the flat support unit, including the arrangement of holes to accommodate threaded mounting studs and the pre-cut tabs which are used to secure the section to the adjustable support unit.

FIG. 18 shows support unit 118 in the form of a flat template which is provided in the embodiment of FIG. 17 and showing the position of mounting holes 20 and the position of tabs 116 before folding.

In summary, the inventive concrete expansion joint assembly allows height adjustment before and during the pouring of concrete, thus allowing greater freedom in achieving the correct height adjustment, while saving set-up costs. The inventive technique eliminates the need to saw the joint in the concrete, as with prior art methods, since the joint is ready before the concrete is poured.

In the case of mortar or plaster work in wall finishing, the present invention allows the surface of a wall to be accurately leveled and smoothed by passing a screed over the exposed edge of the adjustable height surface guide mounted on the wall in accordance with the present invention. The guide can be either removed after the surface has partially dried, or left permanently fixed which may be useful to decoratively mark separate wall sections.

Having described the invention with regard to certain specific embodiments, it is to be understood that the description is not meant as a limitation, since further modifications may now present themselves to those skilled in the art, and it is intended to cover such modifications as fall within the scope of the appended claims.

What is claimed is:

1. A continuously height-adjustable concrete section joint assembly for placement prior to pouring a concrete slab surface, comprising:

section means extending longitudinally and being shaped for holding a flexible material; and means for supporting said section means at an adjustable height within a continuous range of height positions, said height adjustment being provided before completion of pouring of concrete, such that an upper edge portion of said flexible material is visible flush with the concrete slab surface, providing it with a desired reference for determination of the height and slope of the concrete surface.

2. The assembly of claim 1 wherein said supporting means comprises a plurality of threaded mounting studs, each having threaded thereon a nut shaped with a groove for receiving a retaining spring by which said section means is supported.

3. The assembly of claim 2 wherein said studs are of a desired height.

4. The assembly of claim 1 wherein said supporting means is separately installed prior to said section means.

5. The assembly of claim 1 wherein said supporting means is rigidly connected to a base material on which the concrete slab is poured, said base material comprising one of compacted gravel, wood, pre-cast concrete and the like.

6. The assembly of claim 1 comprising a plurality of said section means, and a plurality of said supporting means spaced apart to support said section means, said flexible material being supported to form a curved layout.

7. The assembly of claim 1 wherein said flexible material is an elastomeric material, providing a concrete expansion joint.

8. The assembly of claim 7 wherein an upper portion of said elastomeric material is shaped with a slanted upper edge, forming opposite thereto a beveled edge in said concrete slab.

9. The assembly of claim 2 further comprising a pair of hollow cylindrical members each seated over one of said mounting studs, each cylindrical member having rigidly attached thereto a ring through which there passes a dowel bar supported thereby, said dowel bar providing the concrete slab with increased strength.

10. The assembly of claim 1 wherein said longitudinal section means comprises rail means extending longitudinally and being formed with a protruding inverted U-shaped middle rib, with a flexible rib covering said inverted U-shaped middle rib.

11. The assembly of claim 10 wherein said middle rib guides the cracks that form in the concrete slab surface.

12. The assembly of claim 1 wherein said longitudinal section means forms an inverted T-shape, comprising rail means extending longitudinally and a vertical middle rib having side walls substantially closed one against the other, with a flexible rib covering said middle rib.

13. The assembly of claim 1 wherein said longitudinal section means comprises rail means extending longitudinally and being formed with an inverted holder for holding an elastomeric material, said inverted holder having side walls substantially parallel one to the other, defining a space there between.

14. The assembly of claim 1 wherein said longitudinal section means forms an inverted T-shape comprising rail means extending longitudinally and a vertical middle rib having side walls substantially closed one against the other and provided with horizontal wings which extend from both sides of said side walls to which a supporting means can be attached.

15. The assembly of claim 14 wherein said supporting means comprises an adjustable flat support unit provided with pre-cut foldable tabs with which to secure said support unit to said longitudinal surface.

16. A method for assembling an adjustable height concrete section joint assembly for placement prior to pouring a concrete slab surface, said method comprising the steps of:

providing a section means extending longitudinally and being shaped for holding a flexible material; and supporting said section means at an adjustable height, said height adjustment being provided before completion of pouring of concrete, such that an upper edge portion of said flexible material is visible even with the concrete slab surface, providing it with a desired reference height and slope.

17. An adjustable thickness section joint assembly for placement prior to applying a wall plaster coating, comprising section means extending longitudinally and being shaped for holding a flexible material; and means supporting said section means at an adjustable spacing from the wall, said spacing adjustment being provided before completion of a wall plaster coating application, such that an upper edge portion of said flexible material is visible even with the wall surface, providing it with a desired reference thickness and slope.

* * * * *